US011959492B2

(12) United States Patent
Soulek et al.

(10) Patent No.: US 11,959,492 B2
(45) Date of Patent: Apr. 16, 2024

(54) HYBRID AFTER COOLING SYSTEM AND METHOD OF OPERATION

(71) Applicant: POWEREX-IWATA AIR TECHNOLOGY, INC., Harrison, OH (US)

(72) Inventors: Abbey Soulek, Cincinnati, OH (US); Aaron Hunter, Mt. Juliet, TN (US); Joseph A. Abt, Harrison, OH (US); Jeff Heyser, Lebanon, OH (US)

(73) Assignee: Powerex-Iwata Air Technology, Inc., Harrison, OH (US)

( * ) Notice: Subject to any disclaimer, the term of this patent is extended or adjusted under 35 U.S.C. 154(b) by 576 days.

(21) Appl. No.: 16/674,660

(22) Filed: Nov. 5, 2019

(65) Prior Publication Data

US 2020/0141423 A1 May 7, 2020

Related U.S. Application Data

(60) Provisional application No. 62/755,628, filed on Nov. 5, 2018.

(51) Int. Cl.
*F04D 29/58* (2006.01)
*F04D 25/02* (2006.01)

(52) U.S. Cl.
CPC ..... *F04D 29/58* (2013.01); *F04D 25/02* (2013.01)

(58) Field of Classification Search
CPC .. F04D 29/58; F04D 29/5826; F04D 29/5833; F04D 25/08; F28F 2250/08; F28D 1/0233
See application file for complete search history.

(56) References Cited

U.S. PATENT DOCUMENTS

2015/0329125 A1* 11/2015 Mizufune ..... F01C 21/007 165/122
2017/0167797 A1* 6/2017 Tomioka ..... F28D 7/1661
2017/0350412 A1* 12/2017 Hioki ..... F04D 29/5833

FOREIGN PATENT DOCUMENTS

GB 299675 A * 11/1928
JP 2016133038 A * 7/2016 ..... F04D 29/164

* cited by examiner

*Primary Examiner* — Philip E Stimpert

(57) ABSTRACT

A pump assembly and method of cooling process air generated by the pump. The assembly includes a pump and a motor coupled by a gear arrangement. The pump has a cooling air intake and a cooling air exhaust and a process air intake and a process air discharge. The assembly also includes a heat exchanger having a process air inlet and a process air outlet. The assembly includes isolated first and second regions such that within the first region the cooling air exhaust of the pump is positioned at a first stage of tubing within the heat exchanger and further such that within the second region the cooling air intake of the pump is positioned at a second stage of tubing within the heat exchanger.

20 Claims, 7 Drawing Sheets

HYBRID AFTER COOLING SYSTEM AND METHOD OF OPERATION

CROSS REFERENCES TO RELATED APPLICATIONS

The following application claims priority under 35 U.S.C. 119(e) to co-pending U.S. Provisional Patent Application Ser. No. 62/755,628 filed Nov. 5, 2018 entitled HYBRID AFTER COOLING SYSTEM AND METHOD OF OPERATION. The above-identified application is incorporated herein by reference in its entirety for all purposes.

TECHNICAL FIELD

The present disclosure relates to a hybrid after cooling system and method of operation, and more particularly, a hybrid after cooling system and method of operation used to reduce the temperature of processed air using cooling air generated by a pump.

BACKGROUND

Compression of air creates residual heat due to the Ideal Gas Law. A typical air compressor will produce discharge air 300-400 degrees F. over ambient temperature. It is standard practice to provide some sort of discharge air-cooling, also known as after cooling. Performance of an after cooler is often characterized as "approach" temperature, which in the context of a compressed air after cooler, can be defined as the temperature of the process air exiting the after cooler minus the ambient air temperature.

After cooling is typically achieved by an air-cooled heat exchanger, although sometimes liquid cooling is utilized. The cooling performance of the heat exchanger depends on the temperature and flow rates of both the process air and the cooling air (or fluid), as well as the mechanical design of the cooling assembly.

SUMMARY

One aspect of the present disclosure includes a pump assembly and method of cooling process air generated by the pump. The assembly includes a pump and a motor coupled by a coupling arrangement. The pump has a cooling air intake, a cooling air exhaust, a process air intake, and a process air discharge. The assembly also includes a heat exchanger having a process air inlet and a process air outlet. The assembly includes isolated first and second regions such that within the first region the cooling air exhaust of the pump is directed at a first stage of tubing within the heat exchanger and further such that within the second region the cooling air intake of the pump is drawn from the ambient air through a second stage of tubing within the heat exchanger into the cooling air intake of the pump.

Another aspect of the present disclosure includes a method of assembling a pump assembly having a first and second stage for cooling process air, the method comprising the steps of providing a pump and a motor coupled by a coupling arrangement, the pump having a cooling air intake, a cooling air exhaust, a process air intake, and a process air discharge; and assembling a heat exchanger comprising: forming first and second regions, the first region isolated from the second region; positioning a first stage of tubing within the first region of the heat exchanger; positioning a second stage of tubing within the second region of the heat exchanger; forming a process air inlet fluidly coupled to the first region; and forming a process air outlet fluidly coupled to the second region; and positioning the heat exchanger relative to the pump such that within the first region the cooling air exhaust from a discharge of the pump and passes through at the first stage of tubing; and positioning the heat exchanger relative to the pump such that within the second region the cooling air intake of the pump passes through at the second stage of tubing.

While yet another aspect of the present disclosure includes A pump assembly having a first and a second stage for cooling process air, the assembly comprising: a pump and a motor coupled by a coupling arrangement, the pump having a cooling air intake and a cooling air exhaust; the pump further having a process air intake and a process air discharge; and a heat exchanger having a process air inlet and a process air outlet coupled to the pump, the heat exchanger comprising: a first region isolated from a second region by a baffle positioned between the first and second regions within the heat exchanger; a first stage of tubing positioned within the first region wherein the cooling air exhaust of the pump is positioned at the first stage of tubing at a first cooling stage wherein the cooling air exhaust of the pump is directed at the heat exchanger such that cooling exhaust air from the pump passes from the exhaust of the pump through the heat exchanger to ambient air during operation and cools the process air during the first cooling stage; and a second stage of tubing positioned within the second region wherein the cooling air intake of the pump is positioned at the second stage of tubing at a second cooling stage, wherein the cooling air intake of the pump is directed at the heat exchanger such that ambient air is drawn though the heat exchanger into the cooling air intake during operation and cools the process air during the second cooling stage, and further wherein the first cooling stage precedes the second cooling stage.

BRIEF DESCRIPTION OF THE DRAWINGS

The foregoing and other features and advantages of the present disclosure will become apparent to one skilled in the art to which the present invention relates upon consideration of the following description of the invention with reference to the accompanying drawings, wherein like reference numerals refer to like parts unless described otherwise throughout the drawings and in which.

Figure 1:
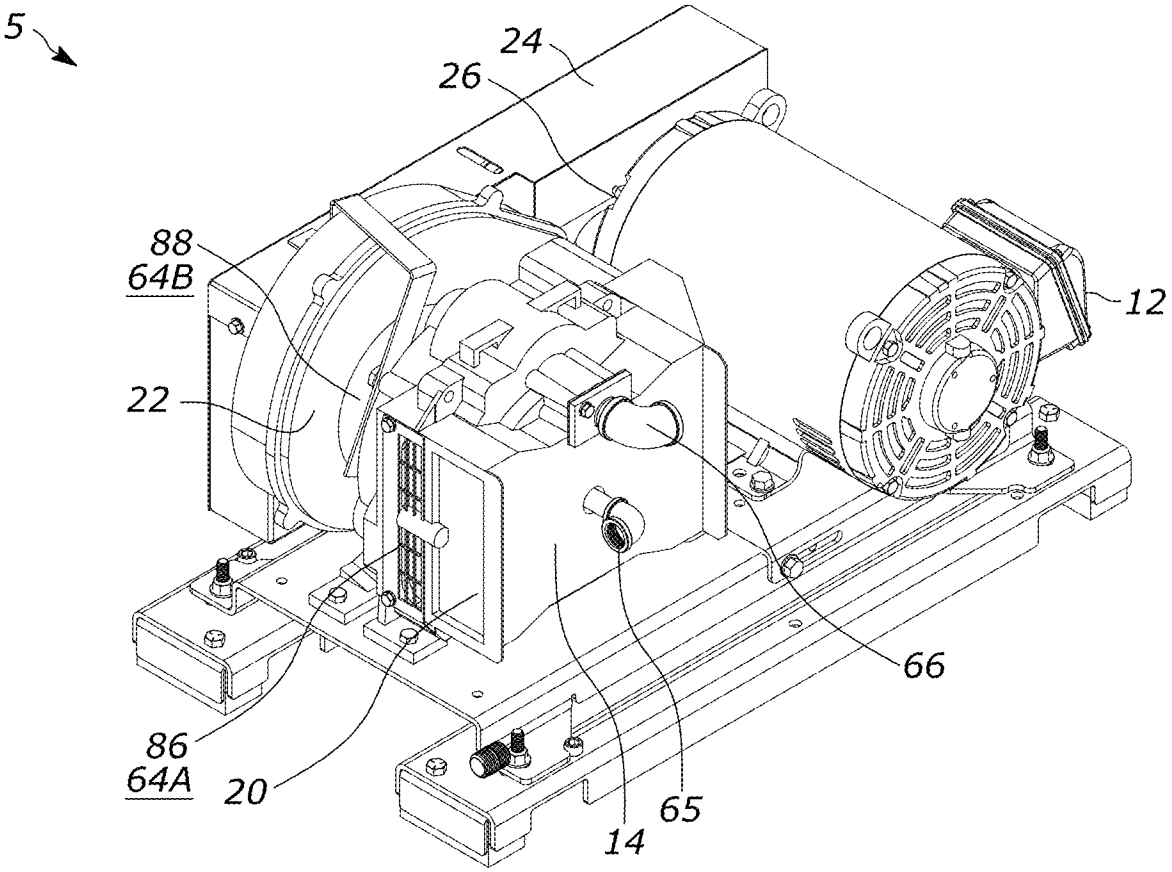
FIG. 1 is a perspective view of an assembly constructed in accordance with one example embodiment.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

The apparatus and method components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

DETAILED DESCRIPTION

Referring now to the figures generally wherein like numbered features shown therein refer to like elements throughout unless otherwise noted. The present disclosure relates to a hybrid after cooling system and method of operation, and more particularly, a hybrid after cooling system and method of operation used to reduce the temperature of processed air using cooling air generated by a pump.

A hybrid after cooling system or assembly 10 involves a hybrid approach to after cooling compressor arrangements. In the illustrated example embodiments of FIGS. 2-5, the assembly 10 is shown being used on a non-enclosed scroll pump manufactured by Powerex, a Scott Fetzer company. It should be appreciated that the assembly 10 can be used by any type of compressor or vacuum pump arrangement. Cooling process air generated by the assembly 10 is important because one or more air dryers typically downstream of a pump arrangement perform more efficiently with cooler air.

Figure 2:
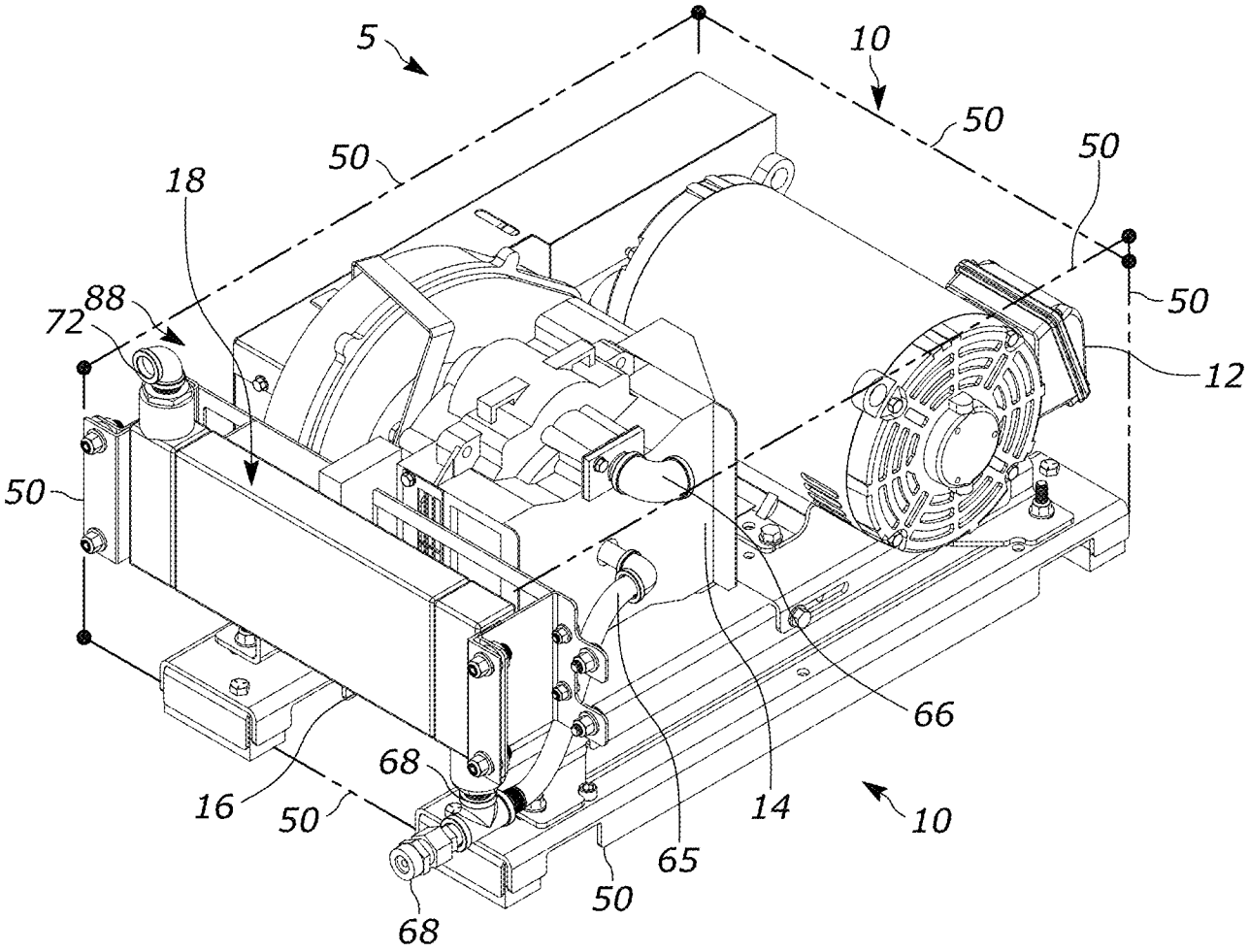
FIG. 2 is a perspective view of a hybrid after cooling system or assembly further comprising an after cooling system constructed in accordance with one example embodiment of the present disclosure.
Figure 3:
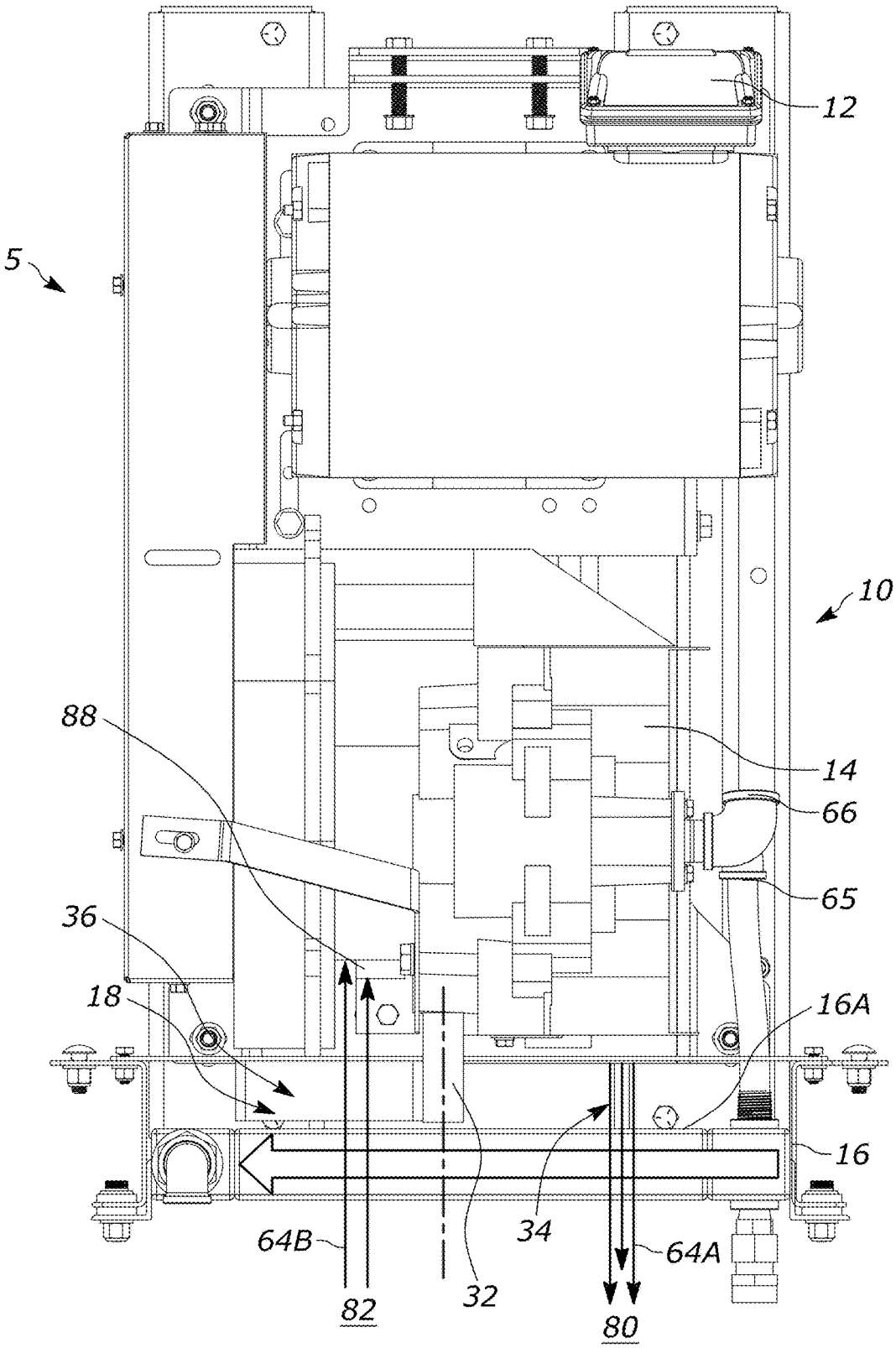
FIG. 3 is a top plan view of FIG. 2.

Referring now to FIG. 1 having an assembly 5 and FIGS. 2-3 that include the assembly 5 fluidly coupled to a hybrid after cooling assembly 10 constructed in accordance with one example embodiment. The hybrid after cooling assembly 10 comprises a motor 12, pump 14, heat exchanger 16, and fan 18. Internally, the pump 14 includes an impeller, fins, vanes and/or any combination thereof that are coupled to a pump shaft 22, which when rotated in a first direction by a gear arrangement 24, the pump acts as an air compressor 20 (see FIG. 1). When the pump shaft 22 is rotated in a second direction by the gear arrangement 24, the pump 14 acts as a vacuum system.

As shown in the illustrated in the example embodiment of FIG. 1, the coupling arrangement 24 couples the pump shaft 22 of the pump 14 to a motor shaft 26 of the motor 12 by pulleys, belts, gears, and or the like to create a mechanical advantage appreciated by those skilled in the art. The compressor 20 when operated by the pump 14 in the illustrated example embodiment, converts rotational energy into compressed or processed air 62 (see FIG. 4). The motor 12 converts electrical energy into rotational energy via the motor shaft 26 that is coupled to the gear arrangement 24 for rotating the pump shaft 22 to generate compressed or processed air 62.

Figure 5:
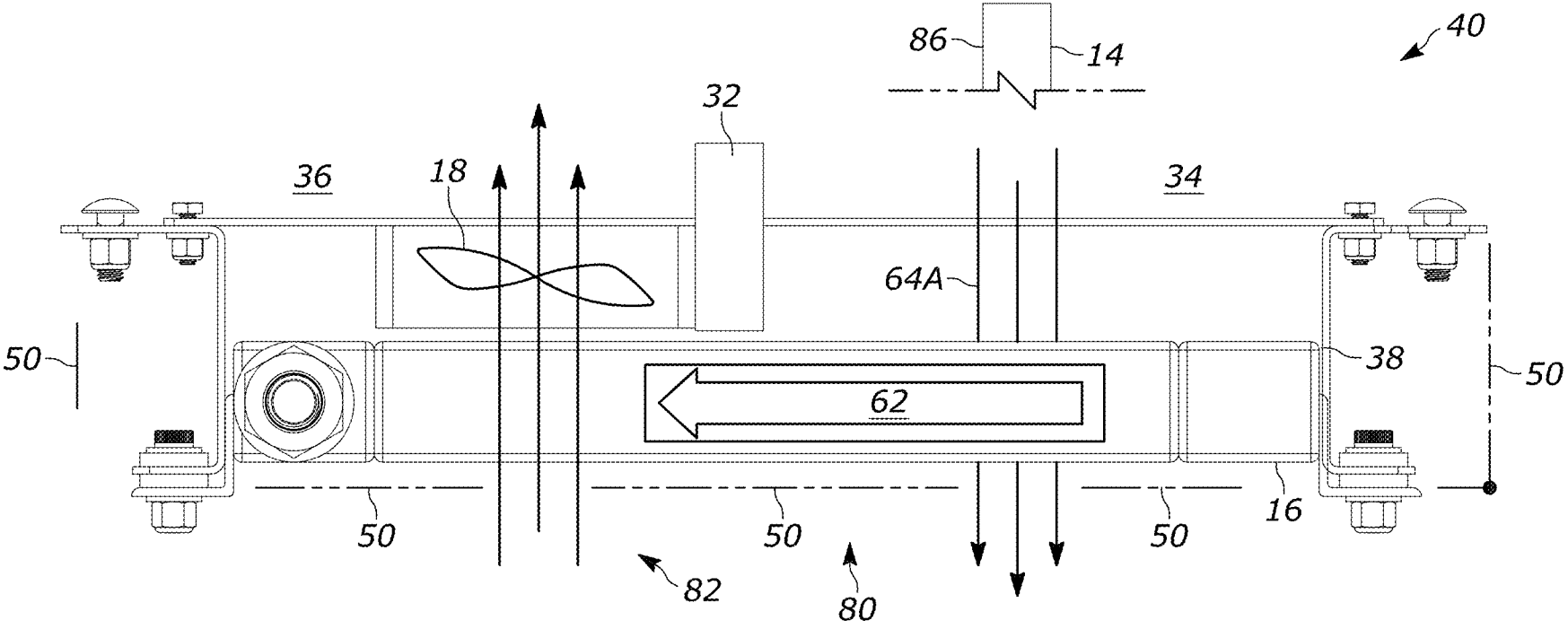
FIG. 5 is a magnified view of the after cooling system of FIG. 2.

An after cooling system 40 is illustrated in FIG. 5 and is part of the assembly 10 as illustrated in FIG. 2. The after cooling system 40 comprises the heat exchanger 16, the fan 18, a separation wall or baffle 32, and a fixture 38 for supporting the fan, separation wall, and heat exchanger. In the illustrated example embodiment of FIG. 2A, the heat exchanger 16 is a conventional heat exchanger having a flow tube 70 passing through a plurality of fins 74 for the convectional transfer of heat. In another example embodiment, the heat exchanger 16 is a traditional brazed bar and plate style design.

In one example embodiment, the assembly 10 operates within an enclosure 50 that is vented to allow the passage of air (see FIGS. 2, 5). Only a skeletal outline of the enclosure 50 is shown in FIG. 2 so that the internal workings of the assembly can be viewed and described. The baffle 32 within the enclosure forms, divides, and isolates first 34 and second 36 air regions or chambers, respectively, (see FIGS. 2A, 3 and 5). In an alternative example embodiment, the assembly 10 is open without an enclosure, however, the baffle 32 still divides the air flow from the inside of the heat exchanger 16 and an air inlet 86 and an air discharge 88 of the cooling air as it passes to/from the pump 14.

Figure 4:
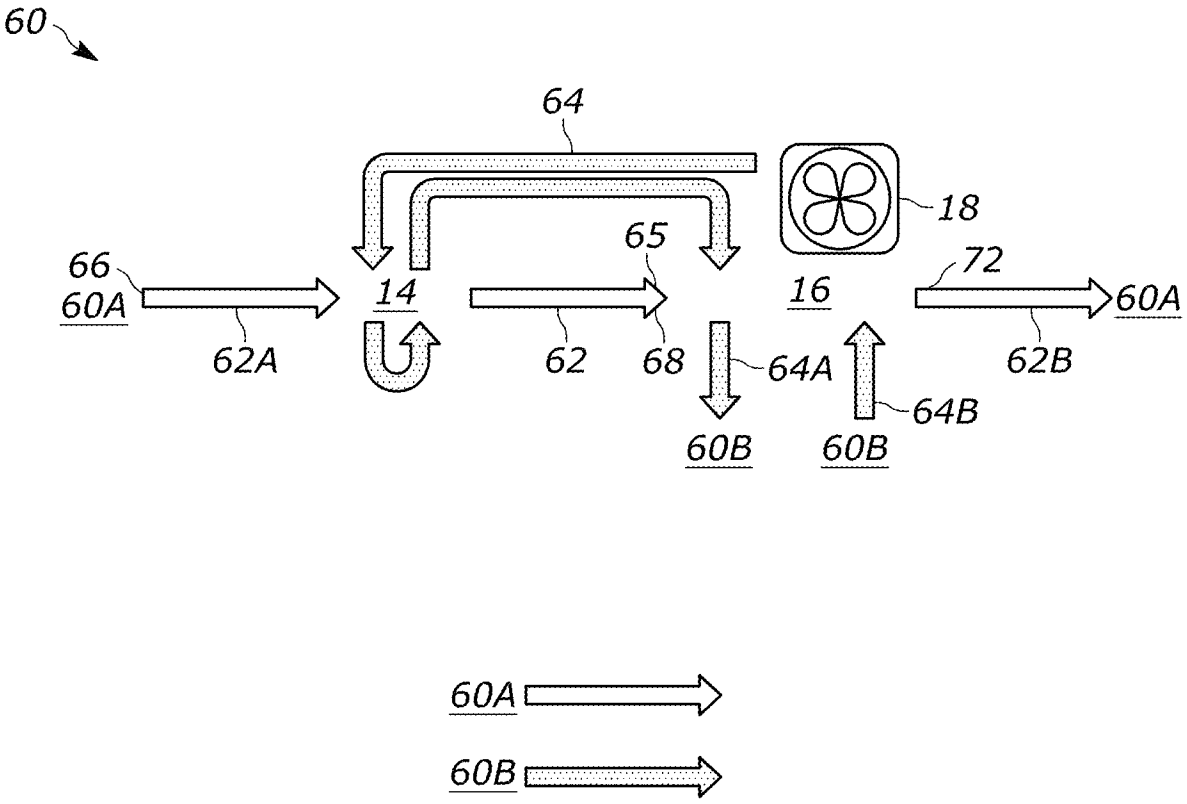
FIG. 4 is a flow diagram of the assembly of FIG. 2 constructed in accordance with one example embodiment.

Referring now to FIG. 4, a flow diagram 60 is illustrated of the assembly 10 illustrated in FIGS. 1-3 and system 40 illustrated in FIG. 5. The flow diagram 60 illustrates two independent and isolated flow paths 60A (process air from the pump 14) and 60B (cooling air to condition the processed air). A first fluid 62 in one example embodiment is the process air 62 that is compressed or pulled (in a vacuum) by the pump 14. And a second fluid 64 in the illustrated example embodiment is cooling air that is used to condition the first fluid 62. While in the illustrated example embodiment the first and second fluids, 62 and 64, respectively are described as a gas, it should be appreciated that they could be a fluid or a combination of gas and fluid without departing from the spirit and scope of the present disclosure.

The first fluid 62 during operation is undesirably at an elevated temperature after it is compressed and exits the pump 14 at a pump discharge 65 (see FIG. 2). The pump 14 receives supply air at a pump intake 66. The pump intake 66 and discharge 65 are graphically illustrated in the flow diagram of FIG. 4. The first fluid 62 is conditioned by the after cooling system 40 after it leaves the pump discharge 65 and enters the system 40 inlet 68 of the heat exchanger 16 and proceeds through substantially parallel passes of tubing 70 (see FIG. 2A) in the heat exchanger to the discharge 72 (connected to piping or hose, not shown, for use such as operating equipment in a plant). The tubing 70 includes a plurality of fins 74 coupled to the tubing to promote convective and conductive forms of heat transfer to cool the first fluid 62 process air.

The second fluid 64 provides cooling air to the heat exchanger 16 by two separate and isolated stages (see FIGS. 4-5). Illustrated in the example embodiment of FIGS. 2A and 5, at a first stage 80 is the first use of the second fluid 64 to condition the first fluid 62 by the passage of cooling air 64A exiting from an exhaust 86 from the operation of the pump 14. The cooling air 64A moves from the exhaust 86 of the pump 14 within the first region 34 through the heat exchanger 16, illustrated in FIGS. 2A and 5, to cool first tubing 70A of the first stage 80, then passing out to the environment or atmosphere.

Figure 2A:
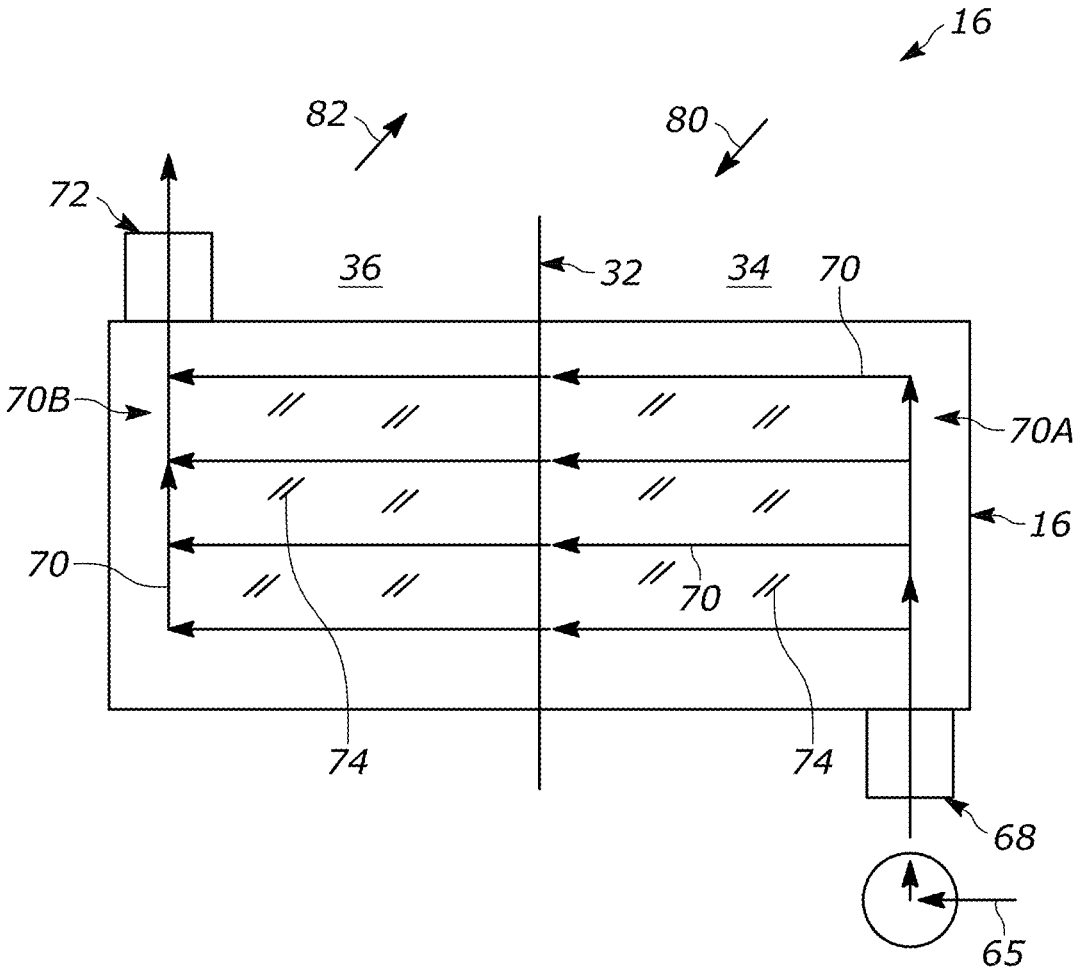
FIG. 2A is a schematic of a heat exchanger and processed air that is cooled as it passes through the after cooling system in accordance with one example embodiment of the present disclosure.

A second stage 82, shown in the illustrated example embodiment of FIGS. 2A and 4, is the second use of the second fluid 64 to condition the first fluid 62 by the passage of cooling air 64B. In the second stage 82, the cooling air 64B is pulled from the environment or atmosphere into the heat exchanger 16 across second tubing 70B positioned in the heat exchanger. The cooling air or second fluid 64B is pulled by the inward directional draw of the fan 18 located in the second region 36. The cooling air 64B is further pulled beyond the fan 18 and into the second region 36 by a supply air inlet 88 (that provides a vacuum, see FIG. 1) of the pump 14.

Illustrated in the example embodiment of FIGS. 2A, and 4, the first and second stages 80, 82, regions 34, 36, and tubing 70A and 70B are isolated from their respective cooling and second fluid 64 cooling air flow (64A and 64B) by the baffle 32 that extends from the top to a bottom of the enclosure and from an inner wall 16A (see FIG. 3) of the heat exchanger 16 to the pump 14 so that the second fluids 64A and 64B are isolated and cannot mix. In the construction of the heat exchanger 16, the tubing 70 passes from the warm cooling flow first 70A during and at the first stage 80 continuing to the cold cooling flow 70B (see FIG. 2A) during and at the second stage 82. The baffle 32 extends to the face of the two regions 34 and 36, contacting the heat exchanger 16 and advantageously increases the efficiency of the assembly 10 and system 40 by preventing the mixing of the cooling at different stages 80 and 82 of cooling air 64A and 64B.

The air flows into the heat exchanger 16 through tubing 70 that starts at a single point, then the tubing is split into several tubes that run the length of the heat exchanger to the single outlet tube, as illustrated in FIG. 2A. Within the tubes 70 there are corrugations or other features that cause turbulence in the flow and increase the cooling of the air as it passes through the heat exchanger 16. The movement of air across the outside heat exchanger 16 creates two cooling stages and increases the cooling capacity of the heat exchanger, not the structure of the tubing.

In the illustrated example embodiment of FIGS. 2A and 4, the heat exchanger 16 is installed on the discharge 65 flow path of the pump 14 to the inlet 68 of the heat exchanger. The fan 18 is positioned to pull cooling air 64B in, rather than away, on the cold side (or second stage 82) of the heat exchanger 16 (see FIG. 3). Cooling air 64B passes through the heat exchanger 16, and is directed to the intake 88 of the pump 14. As illustrated in the example embodiment of FIG. 4, once the pump 14 uses the cooling air 64B for internal cooling, the pump cooling discharge 86 directs cooling air 64A across the hot side (or first stage 80) of the heat exchanger 16. The baffle 32 is provided between the two air streams 64A and 64B in order to ensure correct flow directions, and to prevent undesired mixing of pump 14 exhaust and cool fan air. As such the assembly 10 and system 40 is constructed to effectively provide two stages 80 and 82 of cooling within a single heat exchanger 16. Ambient air is used twice, once to cool the pump discharge air or processed air 60 and once to cool the pump 14 before being expelled away from the compressor or assembly 10. Additionally, the fan 18 increases the charge density of cooling air 64B entering the pump cooling air intake 88, thereby improving the pump 14 cooling performance further.

The construction of the assembly 10 and system 40 as shown and described provides a more efficient method of cooling process air, creating lower approach to ambient than traditional methods of cooling process air from compressors. During testing of the assembly 10 and system 40 as shown and described, approach temperatures reached 16-20 degrees F., which is a 30-40 degrees F. temperature improvement over conventional cooling designs. Cooling performance of process air is important for different reasons. For example, air dryers typically downstream of the pumps do not perform well with hot process air.

Figure 6:
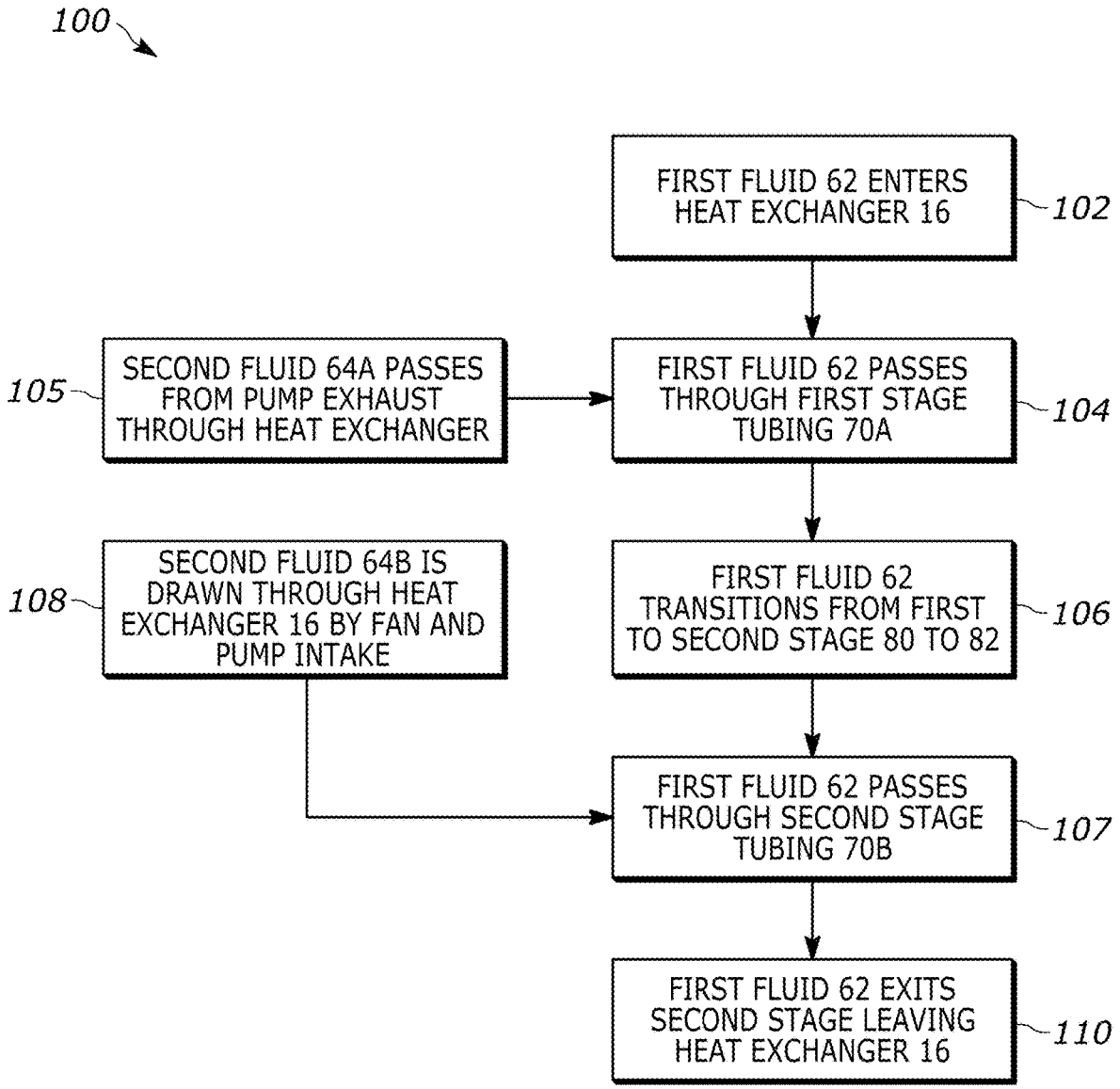
FIG. 6 is a flow chart illustrating a process of cooling process air in accordance with one example embodiment of the present disclosure.

Illustrated in FIG. 6 is a process 100 for cooling process air 64 in accordance with one example embodiment. At 102, the process 100 passes a first fluid 62 from the pump 14 discharge 65 to the heat exchanger 16 intake 68 initiating a first stage 80 (see FIGS. 2, 4-5). At 104, the process 100 draws the first fluid 62 through a first region 34 of the heat exchanger in through a plurality of tubing 70A (see FIGS. 2A, 4). At 105, while the first fluid 62 is in the first stage 80 and within the first region 34 of the heat exchanger 16, a second fluid 64A passes from the pump's cooling air exhaust 86 through the first region 70A of the heat exchanger and out to environment or atmosphere, cooling the first fluid 62 during the first stage (see FIGS. 2A, 4).

At 106, the process 100 draws the first fluid 62 from the first stage 80 to the second stage 82 as it transitions in the heat exchanger 16 tubing 70 from the first region 34 to the second region 36 (see FIG. 2A). At 107, the process 100 passes the first fluid 62 through the second stage tubing 70B. At 108, the process 100 cools the first fluid 62 while the first fluid is in the tubing of 70B of the second region 36, by a second fluid 64B that is drawn through the heat exchanger 16 from atmosphere by a fan 18 and pump intake 88 (see FIGS. 2A, 3, 4). At 110, the first fluid 62 is conditioned/cooled and exits the second stage 82 when it leaves the heat exchanger 16 discharge 72 (see FIG. 2A).

In the foregoing specification, specific embodiments have been described. However, one of ordinary skill in the art appreciates that various modifications and changes can be made without departing from the scope of the disclosure as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The disclosure is defined solely by the appended claims including any amendments made during the pendency of this application and all equivalents of those claims as issued.

Moreover, in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art. In one non-limiting embodiment the terms are defined to be within for example 10%, in another possible embodiment within 5%, in another possible embodiment within 1%, and in another possible embodiment within 0.5%. The term "coupled" as used herein is defined as connected or in contact either temporarily or permanently, although not necessarily directly and not necessarily mechanically. A device or structure that is "configured" in a certain way is configured in at least that way, but may also be configured in ways that are not listed.

To the extent that the materials for any of the foregoing embodiments or components thereof are not specified, it is to be appreciated that suitable materials would be known by one of ordinary skill in the art for the intended purposes.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

What is claimed is:

1. A pump assembly having a first and second stage for cooling process air, the assembly comprising:

a pump and a motor coupled by a coupling arrangement, the pump having a cooling air intake and a cooling air exhaust for a flow of cooling fluid the pump being cooled by the flow of the cooling fluid from the cooling air intake to the cooling air exhaust;

the pump further configured to cause process air to flow a process air intake to a process air discharge; and an enclosed heat exchanger having a process air inlet and a process air outlet coupled to the pump, the heat exchanger comprising isolated first and second regions such that within said first region said cooling air exhaust of said pump is positioned at a first stage of tubing within said heat exchanger and further such that within said second region said cooling air intake of said pump is positioned at a second stage of tubing within said heat exchanger, wherein the first and second stages of tubing are separated by a baffle, the baffle forming a separation wall that divides and isolates the first region from the second region, further wherein the first and second stages of tubing extend the length of the enclosed heat exchanger, further wherein the first and second stages of tubing comprise multiple parallel tubes, wherein each tube extends from the first region to the second regions, wherein the process air is cooled by the flow of cooling air in the second region before the cooling air flows to the cooling air intake and wherein the process air is cooled in the first region after the cooling air flows from the cooling air exhaust.

2. The pump assembly of claim 1 wherein said first and second regions are isolated by the baffle.

3. The pump assembly of claim 1 wherein said pump is an air compressor.

4. The pump assembly of claim 1 further comprising a fan positioned within said second region.

5. The pump assembly of claim 1 wherein said cooling air exhaust of said pump is directed at said heat exchanger such that exhaust air from said pump passes through the heat exchanger to ambient air during operation and cools said process air during a first cooling stage.

6. The pump assembly of claim 1 wherein said cooling air intake of said pump is directed at said heat exchanger such that ambient air is drawn though the heat exchanger into the cooling air intake during operation and cools said process air during a second cooling stage.

7. The pump assembly of claim 1 wherein said cooling air exhaust of said pump is directed at said heat exchanger such that exhaust air from said pump passes through the heat exchanger to ambient air during operation and cools said process air during a first cooling stage and wherein said cooling air intake of said pump is directed at said heat exchanger such that ambient air is drawn through the heat exchanger into the cooling air intake during operation and cools said process air during a second cooling stage, and further wherein said first cooling stage precedes said second cooling stage.

8. A method of assembling a pump assembly having a first and second stage for cooling process air, the method comprising the steps of:

providing a pump and a motor coupled by a coupling arrangement, the pump having a cooling air intake, a cooling air exhaust, a process air intake, and a process air discharge; and assembling an enclosed heat exchanger comprising:

forming first and second regions, the first region isolated from the second region;

positioning a first stage of tubing within said first region of the heat exchanger;

positioning a second stage of tubing within said second region of said heat exchanger, such that a baffle is between the first and second stages of tubing, wherein the first and second stages of tubing are positioned to extend along a full length of the heat exchanger, wherein the full length extends from a first side of the heat exchanger to a second side of the heat exchanger, further wherein the first region is nearer the first side relative to the second region, and the second region is nearer the second side, relative to the first region;

forming a process air inlet fluidly coupled to the first region; and forming a process air outlet fluidly coupled to the second region; and positioning the heat exchanger relative to the pump such that within said first region said cooling air exhaust from a discharge of said pump and passes through at the first stage of tubing; and positioning the heat exchanger relative to the pump such that within said second region said cooling air intake of said pump passes through at the second stage of tubing, wherein the pump is configured to be cooled by cooling air flowing from the cooling air intake to the cooling air exhaust.

9. The method of claim 8, wherein the step of forming first and second regions comprises the step of installing a baffle to separate the first region from the second region within the heat exchanger.

10. The method of claim 8 further comprising a step of positioning a fan within the second region to draw ambient air into said second region.

11. The method of claim 8, wherein the step of forming first tubing stage and the second tubing stage further comprises the step of utilizing tubing that initiates at the air inlet and splits into several tubes that run a length of the heat exchanger to the process air outlet.

12. The method of claim 11, wherein the step of utilizing tubing further comprises utilizing tubing that has at least one of corrugations, fins, and protuberances.

13. A pump assembly having a first and a second stage for cooling process air, the assembly comprising:

a pump and a motor coupled by a coupling arrangement, the pump having a cooling air intake and a cooling air exhaust for a flow of cooling fluid the pump being cooled by the flow of the cooling fluid from the cooling air intake to the cooling air exhaust;

the pump further configured to cause process air to flow from a process air intake to a process air discharge; and an enclosed heat exchanger having a process air inlet and a process air outlet coupled to the pump, wherein, the enclosed heat exchanger is isolated from the pump and the motor, but for a process air inlet and a process air outlet coupled to the pump; the heat exchanger comprising:

a first region isolated from a second region by a baffle positioned between the first and second regions within the heat exchanger, the baffle comprising a separation wall that isolates the enclosed first region from the enclosed second region;

a first stage of tubing contained within said first region wherein said cooling air exhaust of said pump is positioned at the first stage of tubing at a first cooling stage wherein said cooling air exhaust of said pump is directed at said heat exchanger such that cooling exhaust air from said pump passes from the exhaust of said pump through the heat exchanger to ambient air during operation and cools said process air during the first cooling stage; and a second stage of tubing contained within said second region, the baffle separating the first and second stages of tubing, wherein said cooling air intake of said pump is positioned at the second stage of tubing at a second cooling stage, wherein the first and second stages of tubing comprise at least one tube that extends along a full length of the heat exchanger extending from the process air intake to the process air discharge, wherein said cooling air intake of said pump is directed at said heat exchanger such that ambient air is drawn though the heat exchanger into the cooling air intake during operation and cools said process air during the second cooling stage, and further wherein said first cooling stage precedes said second cooling stage.

14. The pump assembly of claim 13 wherein said pump is at least one of an air compressor and a vacuum.

15. The pump assembly of claim 13 further comprising a fan positioned within said second region.

16. The pump assembly of claim 13 further comprising a fan positioned to draw ambient air into said second region.

17. The pump assembly of claim 13 wherein the first and second stage of tubing comprises one or more fins.

18. The pump assembly of claim 13 wherein the first tubing stage and the second tubing stage comprising tubing that initiates at the air inlet and splits into several tubes that run a length of the heat exchanger to the process air outlet.

19. The pump assembly of claim 13 wherein said first stage of tubing and said second stage of tubing are in fluid communication with said processed air.

20. The pump assembly of claim 17 wherein said fan is positioned between said heat exchanger and said cooling air intake of said pump.

* * * * *